US008241195B2

(12) United States Patent
Yamazaki et al.

(10) Patent No.: US 8,241,195 B2
(45) Date of Patent: Aug. 14, 2012

(54) FOLDER GLUER

(75) Inventors: Hiroshi Yamazaki, Kasugai (JP); Hisashi Hayashi, Kasugai (JP); Hidenori Kokubo, Kasugai (JP)

(73) Assignee: Kabushiki Kaisha Isowa, Aichi (JP)

( * ) Notice: Subject to any disclaimer, the term of this patent is extended or adjusted under 35 U.S.C. 154(b) by 303 days.

(21) Appl. No.: 12/554,187

(22) Filed: Sep. 4, 2009

(65) Prior Publication Data

US 2010/0076619 A1 Mar. 25, 2010

(30) Foreign Application Priority Data

Sep. 24, 2008 (JP) ..... 2008-244800

(51) Int. Cl.
*B31F 1/30* (2006.01)

(52) U.S. Cl. ..... 493/441; 493/10; 493/13; 493/182

(58) Field of Classification Search ..... 493/10, 493/13, 19, 23, 29, 441, 182
See application file for complete search history.

(56) References Cited

U.S. PATENT DOCUMENTS

| | | | | | |
|---|---|---|---|---|---|
| 4,604,083 | A | * | 8/1986 | Barny et al. | 493/34 |
| 4,871,125 | A | * | 10/1989 | Haueter | 242/528 |
| 5,037,365 | A | * | 8/1991 | Breton | 493/18 |
| 5,120,291 | A | * | 6/1992 | Wada et al. | 493/23 |
| 5,383,392 | A | * | 1/1995 | Kowalewski et al. | 101/183 |
| 5,606,913 | A | * | 3/1997 | Kowalewski | 101/183 |

FOREIGN PATENT DOCUMENTS

| | | |
|---|---|---|
| JP | 63-151443 | 6/1988 |
| JP | 11-105160 | 4/1999 |
| JP | 2006-035741 | 2/2006 |

* cited by examiner

*Primary Examiner* — Hemant M Desai
(74) *Attorney, Agent, or Firm* — Stroock & Stroock & Lavan LLP

(57) ABSTRACT

A folder gluer for conveying a cardboard sheet and folding up the cardboard sheet from a deployed state thereof is disclosed. The folder gluer comprises two flat belts including a first belt and a second belt arranged in parallel for conveying a cardboard sheet, two pulleys provided at a starting part or a terminal part in a conveying direction of the folder gluer for respectively driving the first and second flat belts by friction forces, two motors for respectively driving the pulley for the first belt and the pulley for the second belt, a sensor device for respectively detecting the speeds of the first belt and the second belt, and a control device for controlling at least one of the two motors such that a difference in the speeds of the first belt and the second belt detected by the sensor device becomes zero.

14 Claims, 6 Drawing Sheets

FOLDER GLUER

BACKGROUND OF THE INVENTION

The present invention relates to a folder gluer. More specifically, the present invention relates to a folder gluer for conveying and folding up a cardboard sheet from a deployed state thereof.

Conventionally, as an apparatus for correcting a posture of a cardboard sheet to be conveyed, that is, an inclination of a cardboard sheet with respect to a conveying direction, a cardboard sheet posture correcting apparatus is known for, in a process line of a printing and/or a punching, correcting a posture of a sheet WS during a conveyance, so that a reference direction B of the cardboard sheet almost coincides with a sheet feed direction T, by a sheet rotating mechanism which rotates the sheet WS during a conveyance by a predetermined angle within a plane of the sheet, and then for conveying the cardboard sheet to a folder gluer, which is a next process, as disclosed in JP-11-105160-A.

Further, as an apparatus for correcting a posture of a cardboard sheet to be conveyed, in a carton former, a blank shear correcting apparatus is known for activating a shear correcting stopper by a detection signal via an automatic control system, when a blank is detected by a detecting sensor for a blank (a cardboard sheet), so as to correct the blank to a correct posture, and then for conveying the blank to a folder gluer for coving and/or gluing, which is a next process, as disclosed in JP-63-151443-A.

In addition, as an apparatus for correcting a posture of a cardboard sheet to be conveyed, in a folder gluer, an apparatus is known for correcting an inclination of a cardboard sheet by push-pressuring a rear end edge of the box body by a push pawl of the conveying belt with the pawls, so as to be pushed against a positioning member, and then pinching the box body from both the front and rear sides with the push pawl, as disclosed in JP-2006-035741-A.

In a folder gluer, a cardboard sheet is conveyed by two conveyer belts, in general. The inventors of the present invention have found by an experimental proof that, in the folder gluer, an inclination of a posture of the cardboard sheet from a normal posture is caused by a difference in the conveyance speeds of two conveyer belts. That is, when driving a frictional transmission belt (a flat belt) by a pulley with a frictional force, a speed difference is generated between two belts according to causes such as (1) a change in a surface texture by a variation with time of the belt surface which contacts the pulley differs between two belts (a change in a frictional transmission force between the pulley and the belt), (2) a variation in the conveyance speed by a speed-up of the conveyance speed of the conveyer belt, and (3) a load of the cardboard sheet to be conveyed, thereby the cardboard sheet is inclined with respect to the conveyance direction. Such inclination may result in a deformation of a box in the sheet folding-up step, and will causes a serious problem generating to be connected with a production deficiency. In particular, according to the aforementioned causes, the variation with time in which the speed variation of the conveyer belts varies slowly in time-wise will occur, and when, in the folder gluer, a great number of cardboard sheets would be conveyed continuously in a high speed, even though the folding-up could be made quite well in the first batch as shown in FIG. 8 (*a*), when the conveyance speed D would differ as shown in FIG. 8 (*b*), the problem could be caused, in which the deficiency would be generated in the last batch.

In the meantime, assuming that the cardboard sheet would be inclined with respect to the conveyance direction, the apparatuses disclosed in the aforementioned Japanese Patent Publications are provided with the rotating mechanism for correcting an inclination of a cardboard sheet (JP-11-105160-A), the blank shear correcting stopper (JP-63-151443-A), and the positioning member and the pushing pawl (JP-2000-0355741-A), and thus the apparatuses become a major structure, and costs much more. In addition, a displacement in an inclination of the cardboard sheet cannot be overcome by the aforementioned Japanese Patent Publications, and as a result, if the conveyance speed of the conveyer belt would be sped up as being desired in the industry, it could be difficult to correct the cardboard sheet to a normal posture accurately with the conventional art such as disclosed in the Japanese Patent Publications.

On the other hand, although the speed difference between two belts could be prevented to almost zero by arranging two conveying belts to be timing belts (synchronous belts), the timing belts are required to form the tooth part in order to obtain an accurate timing, the timing belts have a constraint condition such as a requirement of using a thick belt and an endless belt, and the timing belts are further expendable parts. Accordingly, the timing belts become extremely expensive.

BRIEF SUMMARY OF THE INVENTION

It is therefore an object of the present invention to provide a folder gluer for preventing an inclination of a cardboard sheet with respect to a conveying direction thereof.

The above object is achieved according to the present invention by providing a folder gluer for conveying a cardboard sheet and folding up the cardboard sheet from a deployed state thereof, the folder gluer comprising two flat belts including a first belt and a second belt arranged in parallel for conveying a cardboard sheet, two pulleys provided at a starting part or a terminal part in a conveying direction of the folder gluer for respectively driving the first and second flat belts by friction forces, two motors for respectively driving the pulley for the first belt and the pulley for the second belt, a sensor device for respectively detecting the speeds of the first belt and the second belt, and a control device for controlling at least one of the two motors such that a difference in the speeds of the first belt and the second belt detected by the sensor device becomes zero.

According to the present invention explained above, since the folder gluer has two flat belts including a first belt and a second belt arranged in parallel for conveying a cardboard sheet, and two pulleys provided at a starting part or a terminal part in a conveying direction of the folder gluer for respectively driving the first and second flat belts by friction forces, although the difference in the speeds of both flat belts, etc. caused by the decrease in friction force may be generated, the speeds of two flat belts are detected by the sensor device, and at least one of two driving motors for two flat belts is controlled by the control device such that the difference in the speeds of two flat belts becomes zero, thereby an inclination of the cardboard sheet in the conveying direction may be prevented.

In a preferred embodiment of the present invention, the control device controls both of the two motors such that the speeds of the first belt and the second belt respectively become a reference speed.

According to the embodiment of the present invention explained above, the decrease in the speeds of both flat belts caused by a decrease in friction force may be prevented, and thereby an inclination of the cardboard sheet in the conveying direction may be prevented more securely.

In another preferred embodiment of the present invention, the control device controls one of the two motors such that one of the speeds of the first belt and the second belt coincides with the other of the speeds.

According to the embodiment of the present invention explained above, an inclination of the cardboard sheet in the conveying direction may be prevented easily.

The above object is also achieved according to the present invention by providing a folder gluer for conveying a cardboard sheet and folding up the cardboard sheet from a deployed state thereof, the folder gluer comprising two flat belts including a first belt and a second belt arranged in parallel for conveying a cardboard sheet, two pulleys provided at a starting part or a terminal part in a conveying direction of the folder gluer for respectively driving the first and second flat belts by friction forces, one motor for driving the pulley for the first belt, a driving shaft for connecting the pulley for the first belt driven by the one motor with the pulley for the second belt to transmit a driving force of the pulley for the first belt to the pulley for the second belt, a differential device provided on the driving shaft for generating a difference in the speeds of the pulley for the first belt and the pulley for the second belt, a sensor device for respectively detecting the speeds of the first belt and the second belt, and a control device for controlling at least one of the one motor and the differential device such that a difference in the speeds of the first belt and the second belt detected by the sensor device becomes zero.

According to the present invention explained above, since the folder gluer comprises two flat belts including a first belt and a second belt arranged in parallel for conveying a cardboard sheet, and two pulleys provided at a starting part or a terminal part in a conveying direction of the folder gluer for driving the first and second flat belts by friction forces, although the difference in the speeds of both flat belts, etc. caused by the decrease in friction force may be generated, the speeds of two flat belts are detected by the sensor device, and at least one of the one motor and the differential device is controlled by the control device such that the difference in the speeds of the first belt and the second belt becomes zero, thereby an inclination of the cardboard sheet in the conveying direction may be prevented.

In a preferred embodiment of the present invention, the control device controls both of the one motor and the differential device such that the speeds of the first belt and the second belt respectively become a reference speed.

According to the embodiment of the present invention explained above, an inclination of the cardboard sheet in the conveying direction may be prevented more securely.

In another preferred embodiment of the present invention, the control device controls the differential device such that the speed of the second belt coincides with the speed of the first belt.

According to the embodiment of the present invention explained above, an inclination of the cardboard sheet in the conveying direction may be prevented easily.

In still another preferred embodiment of the present invention, the sensor device comprises sensor tags and two pairs of tag sensors, the sensor tags being respectively provided in the first belt and the second belt, the two pairs of tag sensors being provided along the first belt and the second belt to be separated from one another at a predetermined distance in a conveying direction for detecting the passages of the sensing tags to respectively detect the speeds of the first belt and the second belt.

According to the embodiment of the present invention explained above, the speeds of the first belt and the second belt may be detected more securely.

In another embodiment of the present invention, the tag sensors are photoelectronic sensors.

According to the embodiment of the present invention explained above, the sensing tags such as the reflectors or visors may be detected by the photoelectronic sensors more securely.

In another embodiment of the present invention, two or more of said sensing tags are provided.

According to the embodiment of the present invention explained above, a nearly real-time control may be implemented by arranging the predetermined distances of the tag sensors to be small and detecting the two or more sensing tags one after another, for example.

In another embodiment of the present invention, the motor is a servomotor.

In the embodiment of the present invention explained above, a high controllability may be obtained, and the equalization of the speeds of two belts may be achieved regarding the speed variation factors. Preferably a vector-inverter type motor or a general-purpose motor may also be used.

Accordingly, the folder gluer of the present invention enables to prevent an inclination of a cardboard sheet with respect to a conveying direction thereof, and thus it is not required to provide specifically an inclination correcting device contacting with a cardboard sheet to be conveyed.

The above and other objects and features of the present invention will be apparent from the following description by taking reference with accompanying drawings employed for preferred embodiments of the present invention.

DETAILED DESCRIPTION OF THE PREFERRED EMBODIMENTS

Hereinafter, the preferred embodiments of the present invention will be described with reference to the accompanying drawings.

Figure 1:
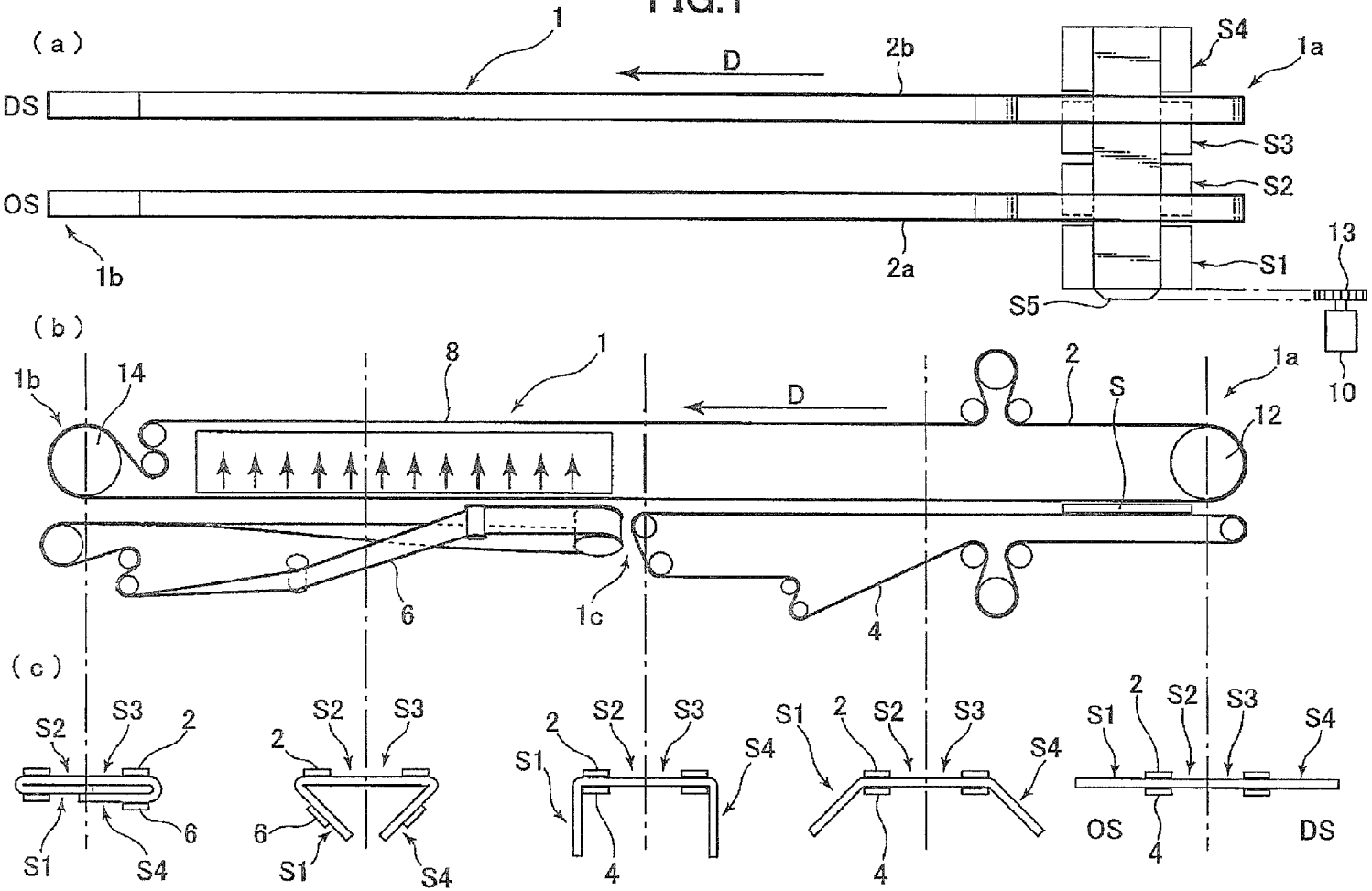
FIG. 1 (*a*) is a plane view showing an overall configuration of the folder gluer according to the first embodiment of the present invention, FIG. 1 (*b*) is a side view, and FIG. 1 (*c*) is a view showing folding-up states of a cardboard sheet, respectively.

First, an overall configuration of a folder gluer according to the first embodiment of the present invention will be described with reference to FIG. 1. FIG. 1 (*a*) is a plane view showing an overall configuration of the folder gluer according to the first embodiment of the present invention, FIG. 1 (*b*) is a side view, and FIG. 1 (*c*) is a view showing folding-up states of a cardboard sheet, respectively.

As shown in FIG. 1 (*b*), a folder gluer 1 includes a folding upper belt 2, 2*a*, 2*b* a folding lower belt 4, and a folding-up belt 6. The folding upper belt 2, the folding lower belt 4 and the folding-up belt 6 are provided, each having two belts, on opposite sides of the folder gluer 1, respectively. Each folding lower belt 4 extends from the starting part 1*a* in the conveying direction D (the arrow D in FIGS. 1 (*a*) and 1 (*b*)) to the middle part 1*c*, and each coving belt 6 extends from the middle part 1*c* in the conveying direction D to the terminal part 1*b*.

As shown in FIG. 1 (*a*), the folding upper belt 2 includes the operator side (OS) belt 2*a* and the drive side (DS) belt 2*b* and extends from the starting part 1*a* in the conveying direction D to the terminal part 1*b*. Each length of these belts 2*a*, 2*b* is about 10 meters, for example. The folding upper belt 2 is a flat belt, and the pulley 12 is provided at the starting part 1*a* and the pulley 14 is provided at the terminal part 1*b*. Then, as will be described below, the pulleys 14, 14*a*, 14*b* are driven by the motors 20*a*, 20*b*, respectively (see FIG. 2) and transmit the respective driving forces to the folding upper belts 2*a*, 2*b* by the respective frictional forces between the respective pulley 14*a*, 14*b* and the respective folding upper belts 2*a*, 2*b* which are the flat belts.

The cardboard sheet S is sent from the operating areas of printing and/or punching to the folder gluer 1, and in the first half portion (the starting part 1*a*—the middle part 1*c*) of the folder gluer 1, the cardboard sheet S is tucked between the folding upper belt 2 and the folding lower belt 4, as well as being sent in the conveying direction D by the folding upper belt 2 and the folding lower belt 4. A gap between the folding upper belt 2 and the folding lower belt 4 is adjusted so as to be slightly less than a thickness of the cardboard sheet S, and thus a sufficient conveying force is applied to the cardboard sheet S. In this first half portion, it is configured such that the first portion S1 and the fourth portion S4 of the cardboard sheet S are gradually folded in an orthogonal direction as shown in FIG. 1 (*c*), by the folding-up bar (not shown) provided at the side of the folding lower belt 4.

Then, in the second half portion (the middle part 1*c*—the terminal part 1*b*) of the folder gluer 1, it is configured such that the cardboard sheet S is sent in the conveying direction D by the folding upper belt 2, as well as the first portion S1 and the fourth portion S4 of the cardboard sheet S being completely folded in the direction of 180 degrees in a gradual manner as shown in FIG. 1 (*c*), by the folding-up belt 6. In this second half portion, since the cardboard sheet S needs to be completely bent or folded in the direction of 180 degrees, the folding lower belt 4 for tucking the cardboard sheet S such as in the first half portion cannot be provided therein. As a result, in the present embodiment, it is configured to suck the cardboard sheet S to the folding upper belt 2 by the suction device 8, and a plurality of bores for sucking air and attracting the cardboard S are provided on the folding upper belt 2.

Then, in the starting part 1*a* of the folder gluer 1, the gluing is applied on the gluing tab S5 in the first portion S1 of the cardboard sheet S by the gluing device 10 and the applicator roller 13. By the gluing tab S5 that has been glued, in the terminal part 1*b* of the folder gluer 1, the first portion S1 and the fourth portion S4 of the cardboard sheet S are adhered to each other.

Figure 2:
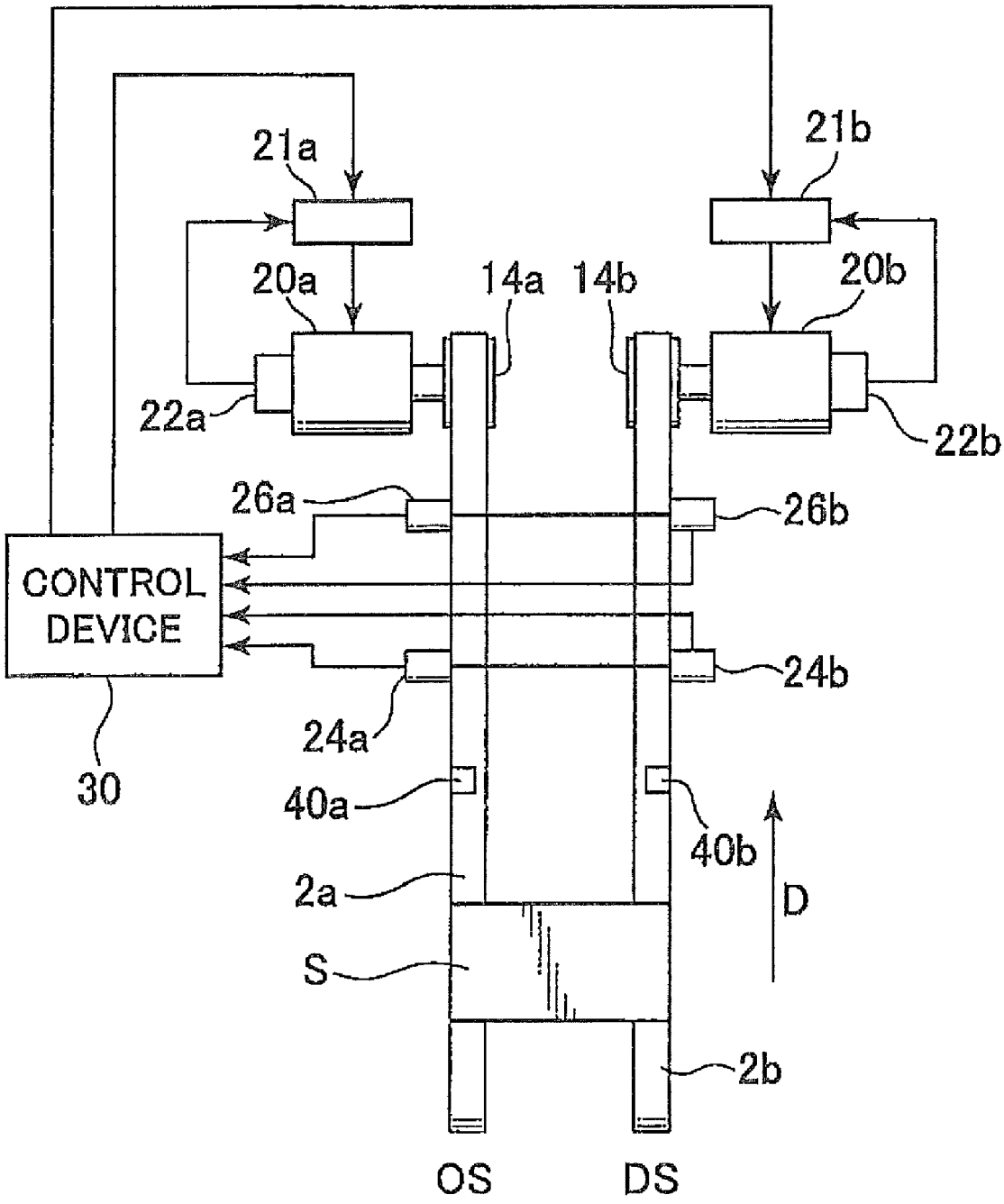
FIG. 2 is a view showing the folder gluer seen from the lower side of the folding upper belt to explain the driving mechanism, the control mechanism and the sensor mechanism for the folding upper belt according to the first embodiment of the present invention.

A driving mechanism, a control mechanism and a sensor mechanism for the folding upper belt according to the first embodiment of the present invention will be described with reference to FIG. 2. FIG. 2 is a view showing the folder gluer seen from the lower side of the folding upper belt to explain the driving mechanism, the control mechanism and the sensor mechanism for the folding upper belt.

First, as the driving mechanism, as shown in FIG. 2, the pulleys 14*a*, 14*b* for the folding upper belt (OS belt) 2*a* and the folding upper belt (DS belt) 2*b* are provided with the servo motors 20*a*, 20*b*, respectively. The servomotors 20*a*, 20*b* are further connected with the servo-amplifiers (servo-amps) 21*a*, 21*b*, respectively. The servo amps 21*a*, 21*b* control the servomotors 20*a*, 20*b*, on the basis of an instruction from the control device 30. The servomotors 20*a*, 20*b* drive the respective folding upper belts 2*a*, 2*b* via the pulleys 14*a*, 14*b*.

Figure 5:
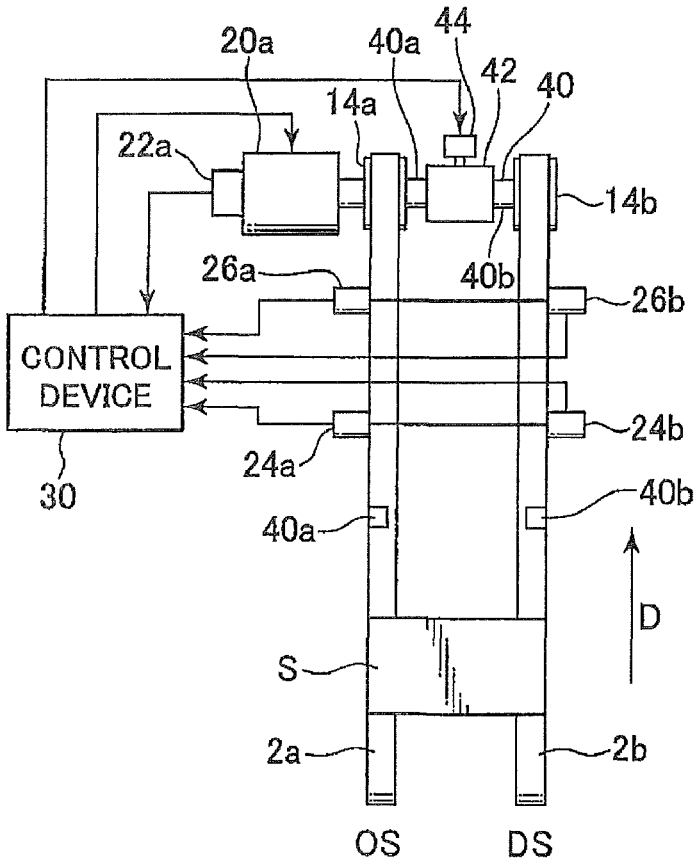
FIG. 5 is a view showing the folder gluer seen from the lower side of the folding upper belt to explain the driving mechanism, the control mechanism and the sensor mechanism for the folding upper belt according to the second embodiment of the present invention.

Preferably a vector-inverter type motor or a general-purpose motor may be used in place of the servomotors 20*a*, 20*b*. In this case, the connection of the motor with the control device 30 is as shown in FIG. 5.

Then, as the control mechanism, the servomotors 20*a*, 20*b* are provided with the pulse encoders 22*a*, 22*b*, respectively, and it is configured such that the detected values of these pulse encoders 22*a*, 22*b* are sent to the servo-amps 21*a*, 21*b*, respectively. In the servo-amps 21*a* 21*b*, an instruction is sent to each of the servomotors 20*a*, 20*b* so as to set them to the predetermined rotational speed, as well as a feedback control is implemented such that the rotational speeds of the servomotors 20*a*, 20*b* become the instructed values based on the detected values of the pulse encoders 22*a*, 22*b*, respectively.

Then, as the sensor mechanism, two folding upper belts 2*a*, 2*b* are provided with the sensing tags 40*a*, 40*b*, respectively, as well as being provided with the first sensors 24*a*, 24*b* and the second sensors 26*a*, 26*b* for respectively detecting these sensing tags 40*a*, 40*b*. The first sensors 24*a*, 24*b* and the second sensors 26*a*, 26*b* are provided to be separated from one another at a predetermined distance (about 1 meter, for example), and detect the passages of the sensing tags 40*a*, 40*b*, respectively. Then, the first sensors 24*a*, 24*b* and the second sensors 26*a*, 26*b* are connected with the control device 30, and it is configured to calculate the speeds of the folding upper belts 2*a*, 2*b* from the distance between the first sensors 24*a*, 24*b* and the second sensors 26*a*, 26*b*, as well as from the time required for the passages of sensing tags 40*a*, 40*b* from the first sensors 24*a*, 24*b* to the second sensors 26*a*, 26*b*, respectively. In order to make the detection error in the speed to be smaller, it is necessary to set the distance between the first sensors 24*a*, 24*b* and the second sensors 26*a*, 26*b* to be larger, for example 1 meter. Further, in order to implement a control nearly in real time, it may be necessary to set the distance between the first sensors 24*a*, 24*b* and the second sensors 26*a*, 26*b* to be smaller, for example, tens of centimeters, as well as to provide two or more sensing tags on the folding belts, so as to continuously measure the passage times of the respective sensing tags. In this case, it is necessary to set the distance between the sensing tags to be larger than the distance between the first sensors 24*a*, 24*b* and the second sensors 26*a*, 26*b*.

Preferably, the first sensors 24*a*, 24*b* and the second sensors 26*a*, 26*b* are photoelectronic sensors, each with high detection accuracy. In this case, the sensing tags 40*a* and 40*b* are reflectors or visors for reflecting or transmitting the signal lights discharged from the photoelectronic sensors. Preferably, the sensing tags 40*a*, 40*b* may be metal plates, and it may implement the detection by letting the first sensors 24*a*, 24*b* and the second sensors 26*a*, 26*b* be the proximity sensors. Preferably, the sensing tags 40*a*, 40*b* may be wireless IC tags, and it may implement the detections by letting the first sensors 24*a*, 24*b* and the second sensors 26*a*, 26*b* be the transceivers.

Herein, in the case of utilizing the aforementioned metal plates or the wireless IC tags as the sensing tags 40*a*, 40*b*, a multilayered structure may be produced by sticking the folding upper belts 2*a*, 2*b* together in multi-layers, and these metal plates or the wireless IC tags may be embedded between these layers.

Further, in place of the sensing tags, the bores may be provided at predetermined locations of the folding upper belts 2*a*, 2*b*, and the photoelectronic sensors may detect the presence or absence of incident light and identify (or detect) the passages of bores.

Figure 3:
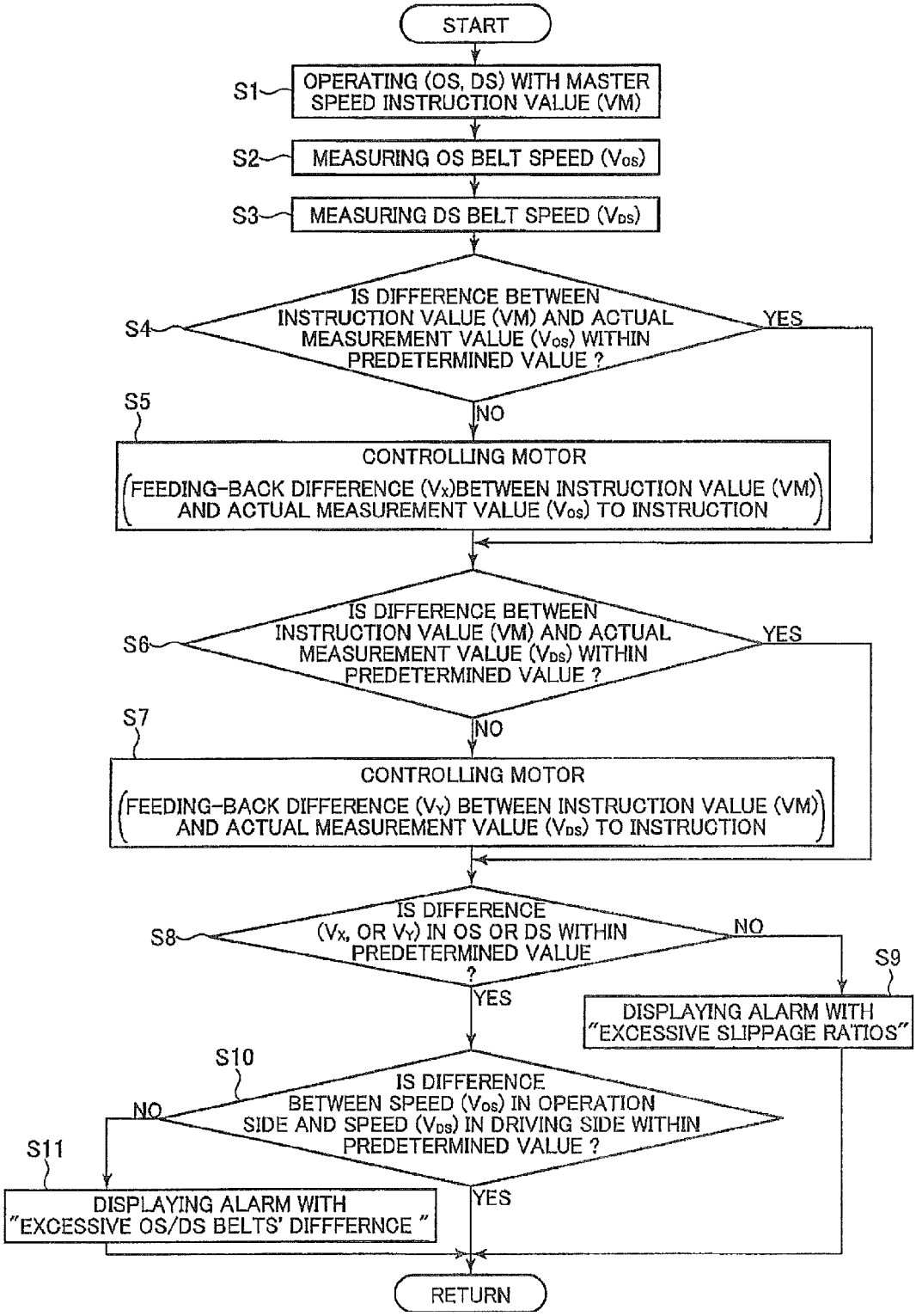
FIG. 3 is a flowchart showing the control operations of the control device according to the first embodiment of the present invention.

In the following, the control operations of the control device according to the first embodiment of the present invention will be described with reference to FIG. 3. FIG. 3 is a flowchart showing the control operations of the control device according to the first embodiment of the present invention. Herein, the symbol S represents a step.

At first, in the step S1, a signal of a master speed instruction value (reference speed) VM is sent to both the motor 20*a* on the operator side (OS) and the motor 20*b* on the drive side (DS), and then the motor 20*a* and 20*b* are driven such that the respective speeds of the folding upper belts 2*a*, 2*b* become this speed VM. This reference speed VM is set as an ideal value in which no slip and the like are generated between the pulleys 14*a*, 14*b* and the folding upper belts 2*a*, 2*b*.

In the step S2, an actual speed ($V_{OS}$) of the folding upper belt 2*a* on the operator side (OS) is detected by the aforementioned sensor mechanism, and in the step S3, an actual speed ($V_{DS}$) of the folding upper belt 2*b* on the drive side (DS) is detected.

Then, in the step S4, it is determined whether the difference $V_X$ between the VM that is the reference speed of the folding upper belt 2 set in the step S1 and the actual measurement value $V_{OS}$ of the folding upper belt 2*a* (OS side) detected in the step S2 is within the predetermined value (the acceptable value). In the case that the cardboard sheet to be conveyed is inclined by an influence of the speed difference of the respective belts 2*a*, 2*b*, the predetermined value is set to be within a small range so that the inclination thereof does not influence a production shape.

In the case of it being larger than the predetermined value, the step proceeds to the step S5, and the motor 20*a* is controlled. Concretely, based on the difference $V_X$ between the VM that is the instruction value and the actual measurement value $V_{OS}$, a feedback control is implemented such that the speed of the folding belt 2*a* driven by the motor 20*a* actually becomes the VM. In the case of it being smaller than the predetermined value, the control in the step S5 is not implemented.

In the step S6, it is determined whether the difference $V_Y$ between the VM that is the reference speed of the folding upper belt 2 set in the step S1 and the actual measurement value $V_{DS}$ of the folding upper belt 2*b* (DS side) detected in the step S3 is within the predetermined value (the acceptable value). Similar to the step S4, in the case that the cardboard sheet to be conveyed is inclined by an influence of the speed difference of the respective belts 2*a*, 2*b*, the predetermined value is set to be within a small range so that the inclination thereof does not influence a production shape.

In the case of it being larger than the acceptable value, the step proceeds to the step S7, and the motor 20*b* is controlled. Concretely, based on the difference $V_Y$ between the VM that is the instruction value and the actual measurement value $V_{DS}$, a feedback control is implemented such that the speed of the holding upper belt 2*b* driven by the motor 20*b* actually becomes the VM. In the case of it being smaller than the predetermined value, the control in the step S7 is not implemented.

In the step S8, it is determined whether or not the speed difference $V_X$ in the operator side (OS) and the speed difference $V_Y$ in the drive side (DS) are within the predetermined value(s), respectively. In the case of it being larger than the predetermined value(s), the step proceeds to the step S9, and an alarm warning indicating that the slippage ratios of the folding upper belts 2*a*, 2*b* becomes excessive is given. In this case, it may be considered that the looseness in the belt tension and/or the slippages between the pulleys 14*a*, 14*b* and the belts 2*a*, 2*b* could be large.

In the step S10, it is determined whether or not the difference between the actual measurement value $V_{OS}$ in the folding upper belt (OS side) 2*a* and the actual measurement value $V_{DS}$ in the folding upper belt (DS side) 2*b* is within the predetermined value. In the case of it being larger than the predetermined value, an alarm warning indicating that a speed difference between the OS side belt 2*a* and the DS side belt 2*b* becomes excessive is given. In this case, the cardboard sheet S may be inclined, and it may be necessary to confirm the gap accuracy.

In place of the controls of the steps S4 through S7 in FIG. 3, preferably the speed difference between the OS side belt 2*a* and the DS side belt 2*b* may be arranged to zero (0) by controlling only one motor 20*a* or 20*b* of the motors on the OS side or on the DS side.

Figure 4:
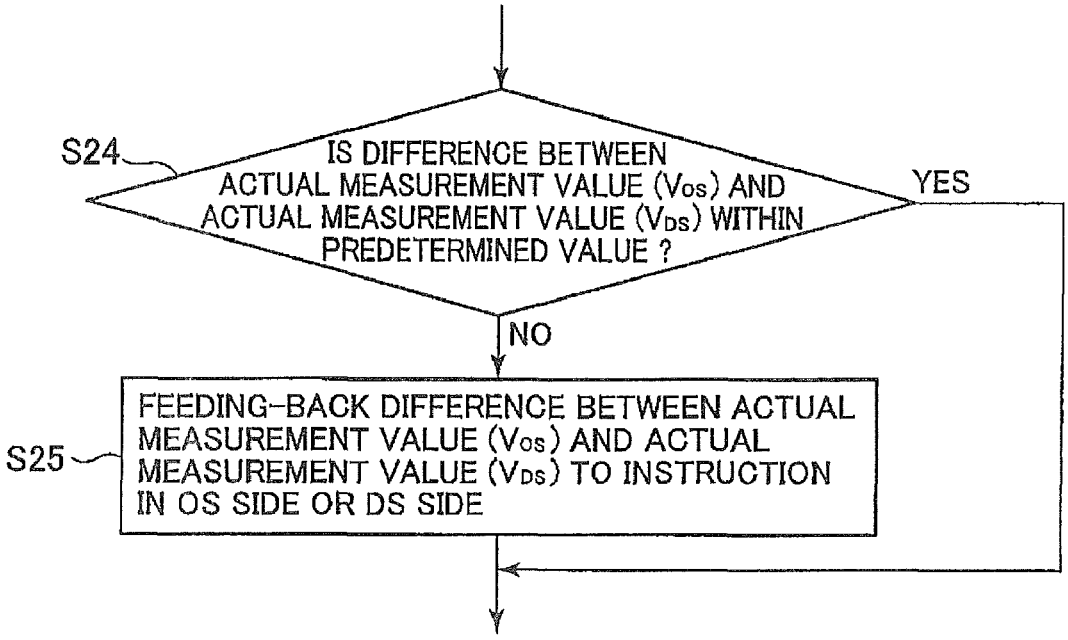
FIG. 4 is a flowchart showing a portion of the control operations of the control device according to an alternative to the first embodiment of the present invention.

That is, as shown in FIG. 4, in the step S24, it is determined whether or not the difference between the actual measurement value $V_{OS}$ in the folding upper belt (OS side) 2*a* and the actual measurement value $V_{Ds}$ in the folding upper belt (DS side) 2*b* is within the predetermined value. In the case that the cardboard sheet to be conveyed is inclined by an influence of the speed difference of the belts 2*a*, 2*b*, the predetermined value is set to be within a small range so that the inclination thereof does not influence a production shape.

In the case of it being larger than the predetermined value, in the step S25, the motor 2*b* on the DS side is controlled such that the speed of the belt 2*b* on the DS side becomes the same as the speed of the belt 2*a* on the OS side, based on the difference between the actual measurement value $V_{OS}$ and the actual measurement value $V_{DS}$. Or the motor 2*a* on the OS side is controlled such that the speed of the belt 2*a* on the OS side becomes the same as the speed of the belt 2*b* on the DS side, based on the difference between the actual measurement value $V_{OS}$ and the actual measurement value $V_{DS}$.

As described above, according to the first embodiment and the alternatives thereof, the speeds of the folding upper belts 2*a*, 2*b* may be arranged to be the same, and as a result thereof, the inclination of the cardboard sheet S with respect to the conveying direction could be prevented.

The folder gluer according to the second embodiment of the present invention will be described.

An overall configuration of the folder gluer according to the second embodiment will be omitted herein, since it is similar to the configuration in FIG. 1 of the above-described first embodiment.

A driving mechanism, a control mechanism and a sensor mechanism for the folding upper belt according to the second embodiment of the present invention will be described with reference to FIG. 5. FIG. 5 is a view showing the folder gluer seen from the lower side of the folding upper belt to explain the driving mechanism, the control mechanism and the sensor mechanism for the folding upper belt.

First, as shown in FIG. 5, the pulley 14*a* for the folding upper belt (OS belt) 2*a* is provided with the servo motor 20*a*. The servo motor 20*a* drives the folding upper belt 2*a* via the pulley 14*a*, based on an instruction from the control device 30. In the control device 30, an instruction is sent to the servomotor 20*a* so as to set it to the predetermined rotational speed, as well as a feedback control is implemented such that the rotational speed of the servomotor 20*a* becomes the instructed value of the control device 30 based on the detected value of the pulse encoder 22*a*.

In the meantime, preferably, using a vector-inverter type motor or a general-purpose motor in place of the servomotors 20*a*, 20*b*, these motors may be connected with the control device 30 as shown in FIG. 5

On the other hand, a driving shaft 40 for connecting the pulley 14*a* with the pulley 14*b* is attached to the pulley 14*b* such that the driving force of the servomotor 20*a* is to be transmitted. That is, the driving force of the servomotor 20*a* is transmitted to the pulley 14*b* via the pulley 14*a* and the driving shaft 40.

Further, in this driving shaft 40, the differential mechanism 42 is provided. This differential mechanism 42 acts as a so-called differential mechanism such that the respective driving shafts 40*a*, 40*b* on the opposite sides of the differential mechanism 42 have different numbers of rotations, and the difference in the numbers of rotations thereof is controlled by the motor 44 connected with the differential mechanism 42.

The sensor mechanism has the same configuration as in the above-described first embodiment, and two folding upper belts 2*a*, 2*b* are provided with the sensing tags 40*a*, 40*b*, respectively, as well as being provided with the first sensors 24*a*, 24*b* and the second sensors 26*a*, 26*b* for respectively detecting these sensing tags 40*a*, 40*b*. Then, the control device 30 calculates the speeds of the folding upper belts 2*a*, 2*b* from the distance between the first sensors 24*a*, 24*b* and the second sensors 26*a*, 26*b*, as well as from the time required for the passages of sensing tags 40*a*, 40*b* from the first sensors 24*a*, 24*b* to the second sensors 26*a*, 26*b*, respectively.

Preferably, the first sensors 24*a*, 24*b* and the second sensors 26*a*, 26*b* are photoelectronic sensors, each with high detection accuracy. In this case, the sensing tags 40*a* and 40*b* are reflectors or visors for reflecting or transmitting the signal lights discharged from the photoelectronic sensors. Preferably, the sensing tags 40*a*, 40*b* may be metal plates, and it may be implement the detection by letting the first sensors 24*a*, 24*b* and the second sensors 26*a*, 26*b* to be as the proximity sensors. More preferably, the sensing tags 40*a*, 40*b* may be wireless IC tags, and it may implement the detections by letting the first sensors 24*a*, 24*b* and the second sensors 26*a*, 26*b* be the transceivers.

Figure 6:
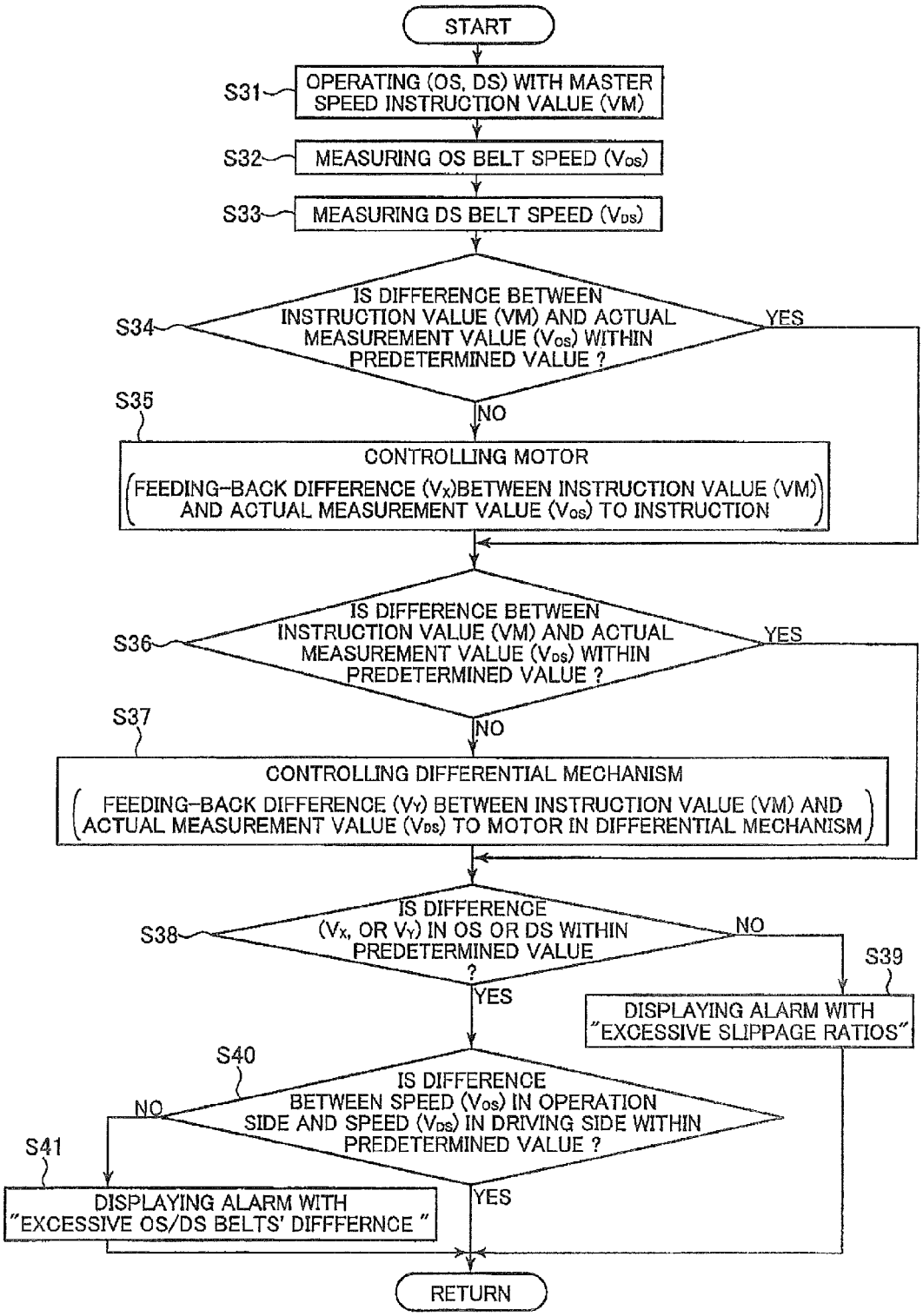
FIG. 6 is a flowchart showing the control operations of the control device according to the second embodiment of the present invention.

The control operations of the control device according to the second embodiment of the present invention will be described with reference to FIG. 6. FIG. 6 is a flowchart showing the control operations of the control device according to the second embodiment of the present invention. Herein, the symbol S represents a step.

First, in the step S31, a signal of a master speed instruction value (reference speed) VM is sent to the motor 20*a* on the operator side (OS), and then the motor 20*a* is driven such that the speed of the folding upper belts 2*a* becomes this speed VM. This reference speed VM is set as an ideal value in which no slip and the like are generated between the pulleys 14*a*, 14*b* and the folding upper belts 2*a*, 2*b*. In this step S31, the differential mechanism 42 is not actuated, and the pulley 14*b* is driven so as to be in the same rotational speed as that of the pulley 14*a*. That is, the folding upper belt 2*a* is driven to be in the speed VM.

In the step S32, an actual speed ($V_{OS}$) of the folding upper belt 2*a* on the operator side (OS) is detected by the aforementioned sensor mechanism, and in the step S33, an actual speed ($V_{DS}$) of the folding upper belt 2*b* on the drive side (DS) is detected.

Then, in the step S34, it is determined whether the difference $V_X$ between the VM that is the reference speed of the folding upper belt 2 set in the step S31 and the actual measurement value $V_{OS}$ of the folding upper belt 2*a* (OS side) detected in the step S32 is within the predetermined value (the acceptable value). In the case that the cardboard sheet to be conveyed is inclined by an influence of the speed difference of the respective belts 2*a*, 2*b*, the predetermined value is set to be within a small range so that the inclination thereof does not influence a production shape.

In the case of it being larger than the acceptable value, the step proceeds to the step S35, and the motor 20*a* is controlled. Concretely, based on the difference $V_X$ between the VM that is the instruction value and the actual measurement value $V_{OS}$, a feedback control is implemented such that the speed of the folding belt 2*a* driven by the motor 20*a* actually becomes the VM. In the case of it being smaller than the predetermined value, the control in the step S35 is not implemented.

In the step S36, it is determined whether the difference $V_Y$ between the VM that is the reference speed of the folding upper belt 2 set in the step S31 and the actual measurement value $V_{DS}$ of the folding upper belt 2*b* (DS side) detected in the step S33 is within the predetermined value (the acceptable value). Similar to the step S34, in the case that the cardboard sheet to be conveyed is inclined by an influence of the speed difference in the respective belts 2*a*, 2*b*, the predetermined value is set to be within a small range so that the inclination thereof does not influence a production shape.

In the case of it being larger than the acceptable value, the step proceeds to the step S37, and the differential mechanism 42 is controlled. Concretely, based on the difference $V_Y$ between the VM that is the instruction value and the actual measurement value $V_{DS}$, a feedback control is implemented such that the speed of the holding upper belt 2*b* driven by the driving shaft 40 actually becomes the VM. In the case of it being smaller than the predetermined value, the control in the step S37 is not implemented.

In the step S38, it is determined whether or not the speed difference $V_X$ in the operator side (OS) and the speed difference $V_Y$ in the drive side (DS) are within the predetermined value(s), respectively. In the case of it being larger than the predetermined value(s), the step proceeds to the step S39, and an alarm warning indicating that the slippage ratios of the folding upper belts 2*a*, 2*b* becomes excessive is given. In this case, it may be considered that the looseness in the belt tension and/or the slippages between the pulleys 14*a*, 14*b* and the belts 2*a*, 2*b* could be large.

In the step S40, it is determined whether or not the difference between the actual measurement value $V_{OS}$ in the folding upper belt (OS side) 2*a* and the actual measurement value $V_{DS}$ in the folding upper belt (DS side) 2*b* is within the predetermined value. In the case of it being larger than the predetermined value, an alarm warning indicating that a speed difference between the OS side belt 2*a* and the DS side belt 2*b* becomes excessive is given. In this case, the cardboard sheet S may be inclined, and it may be necessary to confirm the gap accuracy.

In place of the controls of the steps S34 through S37 in FIG. 6, preferably the speed difference between the OS side belt 2*a* and the DS side belt 2*b* may be arranged to be zero by controlling only the differential mechanism 42.

Figure 7:
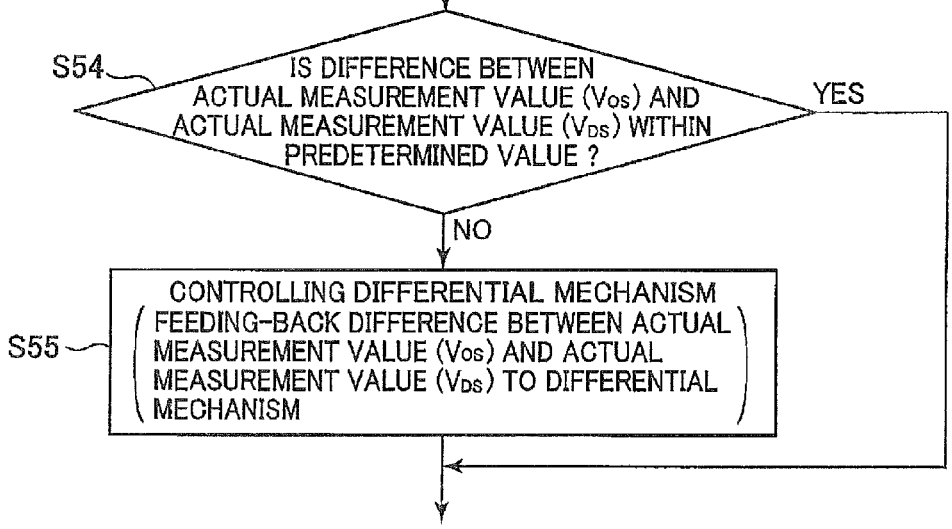
FIG. 7 is a flowchart showing a portion of the control operations of the control device according to an alternative to the second embodiment of the present invention.
Figure 8:
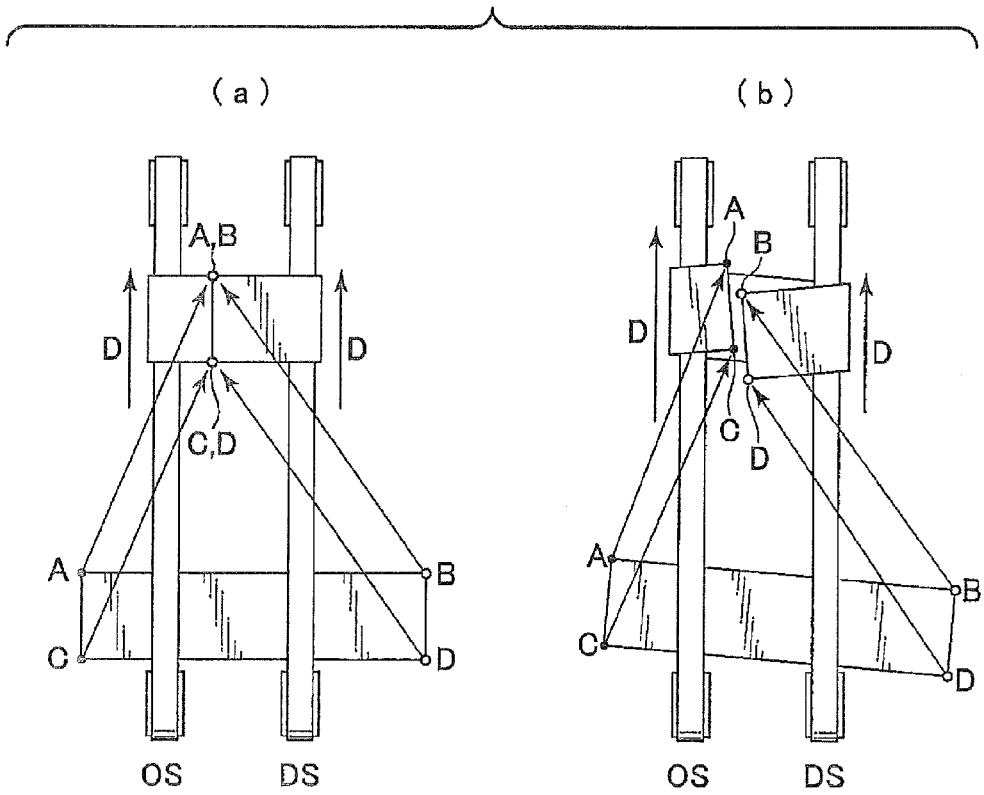
FIG. 8 (*a*) is a view showing one example of a state of the folding-up state of the cardboard sheet in the case that the speeds of two conveying belts are the same, and FIG. 8 (*b*) is a view showing one example of a state of the folding-up state of the cardboard sheet in the case that the speeds of two conveying belts are different.

That is, as shown in FIG. 7, in the step S54, it is determined whether or not the difference between the actual measurement value $V_{OS}$ in the folding upper belt (OS side) 2*a* and the actual measurement value $V_{DS}$ in the folding upper belt (DS side) 2*b* is within the predetermined value. In the case that the cardboard sheet to be conveyed is inclined by an influence of the speed difference of the belts 2*a*, 2*b*, the predetermined value is set to be within a small range so that the inclination thereof does not influence a production shape.

In the case of it being larger than the predetermined value, in the step S55, the differential mechanism 42 is controlled such that the speed of the belt 2*b* on the DS side becomes the same as the speed of the belt 2*a* on the OS side, based on the difference between the actual measurement value $V_{OS}$ and the actual measurement value $V_{DS}$.

In the meantime, in the controls of the steps S35, S37 and S55 in FIGS. 6 and 7, preferably, it may be configured to obtain a desired speed (the speed VM, or the speed of the belt on the OS side or DS side) by controlling both the motor 20*a* and the differential mechanism 42.

As described above, according to the second embodiment and the alternatives thereof, the speeds of the folding upper belts 2*a*, 2*b* may be arranged to be the same, and as a result thereof, the inclination of the cardboard sheet S with respect to the conveying direction could be prevented.

The invention may be embodied in other specific forms without departing from the spirit or essential characteristics thereof. The present embodiments are therefore to be considered in all respects as illustrative and not restrictive, the scope of the invention being indicated by the appended claims rather than by foregoing description and all changes which come within the meaning and range of equivalency of the claims are therefore intended to be embraced therein.

What is claimed is:

1. A folder gluer for conveying a cardboard sheet and folding up the cardboard sheet from a deployed state thereof, said folder gluer comprising:

two flat belts including a first belt and a second belt arranged in parallel for conveying a cardboard sheet;

two pulleys provided at a starting part or a terminal part in a conveying direction of the folder gluer for respectively driving the first and second flat belts by friction forces;

two motors for respectively driving the pulley for the first belt and the pulley for the second belt;

a sensor device for respectively detecting the speeds of the first belt and the second belt; and a control device for controlling at least one of the two motors such that a difference in the speeds of the first belt and the second belt detected by the sensor device becomes zero.

2. A folder gluer according to claim 1, wherein said control device controls both of the two motors such that the speeds of the first belt and the second belt respectively become a reference speed.

3. A folder gluer according to claim 1, wherein said control device controls one of the two motors such that one of the speeds of the first belt and the second belt coincides with the other of the speeds.

4. A folder gluer according to claim 1, wherein said sensor device comprises sensor tags and two pairs of tag sensors, said sensor tags being respectively provided in the first belt and the second belt said two pairs of tag sensors being provided along the first belt and the second belt to be separated from one another at a predetermined distance in a conveying direction for detecting the passages of the sensing tags to respectively detect the speeds of the first belt and the second belt.

5. A folder gluer according to claim 4, wherein said tag sensors are photoelectronic sensors.

6. A folder gluer according to claim 5, wherein two or more of said sensing tags are provided.

7. A folder gluer according to claim 6, wherein said motor is a servomotor.

8. A folder gluer for conveying a cardboard sheet and folding up the cardboard sheet from a deployed state thereof, said folder gluer comprising:

two flat belts including a first belt and a second belt arranged in parallel for conveying a cardboard sheet;

two pulleys provided at a starting part or a terminal part in a conveying direction of the folder gluer for respectively driving the first and second flat belts by friction forces;

one motor for driving the pulley for the first belt;

a driving shaft for connecting the pulley for the first belt driven by the one motor with the pulley for the second belt to transmit a driving force of the pulley for the first belt to the pulley for the second belt;

a differential device provided on the driving shaft for generating a difference in the speeds of the pulley for the first belt and the pulley for the second belt;

a sensor device for respectively detecting the speeds of the first belt and the second belt; and a control device for controlling at least one of the one motor and the differential device such that a difference in the speeds of the first belt and the second belt detected by the sensor device becomes zero.

9. A folder gluer according to claim 8, wherein said control device controls both of the one motor and the differential device such that the speeds of the first belt and the second belt respectively become a reference speed.

10. A folder gluer according to claim 8, wherein said control device controls the differential device such that the speed of the second belt coincides with the speed of the first belt.

11. A folder gluer according to claim 8, wherein said sensor device comprises sensor tags and two pairs of tag sensors, said sensor tags being respectively provided in the first belt and the second belt, said two pairs of tag sensors being provided along the first belt and the second belt to be separated from one another at a predetermined distance in a conveying direction for detecting the passages of the sensing tags to respectively detect the speeds of the first belt and the second belt.

12. A folder gluer according to claim 11, wherein said tag sensors are photoelectronic sensors.

13. A folder gluer according to claim 11, wherein two or more of said sensing tags are provided.

14. A folder gluer according to claim 8, wherein said motor is a servomotor.

* * * * *